US005367839A

United States Patent [19]

Pearce

[11] Patent Number: 5,367,839

[45] Date of Patent: Nov. 29, 1994

[54] ABRASIVE SHEETS

[75] Inventor: Phillip W. Pearce, Washington, England

[73] Assignee: Henkel Kommanditgesellschaft auf Aktien (Henkel KGaA), Duesseldorf, Germany

[21] Appl. No.: 823,941

[22] Filed: Jan. 22, 1992

[51] Int. Cl.[5] ..... B24D 11/00

[52] U.S. Cl. ..... 451/526; 451/56

[58] Field of Search ..... 51/394, 407, 273, 62, 51/170 TL, 325, DIG. 34, 395, 396–406, 293; 101/93.01, 93.07

[56] References Cited

U.S. PATENT DOCUMENTS

| | | | |
|---|---|---|---|
| 1,635,350 | 7/1927 | Simons | 51/395 |
| 2,499,933 | 3/1950 | Smul . | |
| 2,665,528 | 1/1954 | Sternfield et al. | 51/402 |
| 3,116,574 | 1/1964 | Ciesielski | 51/407 |
| 3,121,298 | 2/1964 | Mellon . | |
| 3,638,362 | 2/1972 | Stoll | 51/273 |
| 3,788,011 | 1/1974 | Hutchins | 51/170 R |
| 4,058,936 | 11/1977 | Marton | 51/381 |
| 4,287,685 | 9/1981 | Marton | 51/273 |
| 4,779,385 | 10/1988 | Reiter | 51/273 |
| 4,839,995 | 6/1989 | Hutchins | 51/995 |
| 4,964,245 | 10/1990 | Braasch | 51/394 |
| 5,035,684 | 7/1991 | Sorrells | 493/352 |

FOREIGN PATENT DOCUMENTS

| | | |
|---|---|---|
| 670676 | 4/1952 | United Kingdom . |
| 911602 | 11/1962 | United Kingdom . |
| 1063615 | 3/1967 | United Kingdom . |
| 1247103 | 9/1971 | United Kingdom . |
| 1407628 | 9/1975 | United Kingdom . |
| 2018645 | 10/1979 | United Kingdom . |
| 2057483 | 4/1981 | United Kingdom . |

OTHER PUBLICATIONS

Cover page, U.S. Pat. 3,824,689, issued Jul. 23, 1974 "Piercing of Air Suction Holes in Abrasive Sheet Material" by Hutchins.

Cover page, U.S. Pat. 3,827,194, issued Aug. 6, 1974 "Piercing of Suction Holes in Sanding Disks" by Hutchins.

Cover page, U.S. Pat. 4,549,371, issued Oct. 29, 1985 "Dust Collecting Apparatus for Sander" by Hakoda.

Cover page, U.S. Pat. 3,840,976, issued Oct. 15, 1974 "Method of Piercing Holes in Sanding Discs" by Hutchins.

Cover page, U.S. Pat. 3,854,206, issued Dec. 17, 1974 "Piercing of Suction Holes in Sanding Discs" by Hutchins.

Cover page, U.S. Pat. 3,866,304, issued Feb. 18, 1975 "Method of Piercing Air Suction Holes in Abrasive Sheet Material" by Hutchins.

Cover page, U.S. Pat. 4,949,511, issued Aug. 21, 1990 "Super Abrasive Grinding Tool Element and Grinding Tool" by Endo et al.

Two sheets–DE(A)–P6 "Shaping Non–metal".

*Primary Examiner*—Jack W. Lavinder

[57] ABSTRACT

An abrasive sheet such as sandpaper has standard dimensions to fit ⅓, ½ or ¼ sheet sanding machines having dust extraction facilities. The sheet has perforated delineated separable or frangible areas adapted to be removed by the user to form one pattern of an array of patterns of holes in the sheet to correspond with the holes in the sole plate of the particular model of abrading or sanding machine which the user is employing. This enables one sheet to be used with several different models. Such an arrangement also ensures that the unperforated portions of the sole plate of the abrading machine are covered by unseparated frangible areas of the abrasive sheet. This is accomplished by defining the frangible areas using circular configurations of perforations. A method for using the abrasive sheet includes the steps of separating the appropriate frangible areas from the abrasive sheet and connecting the sheet to the sole plate so that the pattern of separated frangible areas matches the pattern of dust extraction holes in the sole plate of a particular abrading machine.

19 Claims, 2 Drawing Sheets

ABRASIVE SHEETS

BACKGROUND OF THE INVENTION

This invention relates to abrasive sheets for use in power sanding machines having vacuum dust extraction. Sanding machines, by their very nature, generate considerable quantities of dust, and many presently available models provide vacuum extraction facilities which minimize the spread of dust. Orbital sanding machines achieve this by sucking the dust through the sanding machine as it is being generated. For this purpose the sole plate of the sanding machine is provided with numerous holes through which the dust can be extracted. The present invention relates particularly to machines which employ this method of dust extraction. Needless to say, the sheets of abrasive used by machines of this type need to have holes which correspond with the holes in the sole plate. Since machines made by different manufacturers tend to have different patterns of holes in their respective sole plates, each sanding machine requires its own specially-adapted abrasive sheets having the appropriate matching holes.

It has been suggested to provide sheets which have holes pre-punched in them to match all configurations of holes presented by the various manufacturers' sole plates. However, this is not a solution because the holes in the abrasive sheet which do not coincide with holes in the sole plate of any given machine will expose portions of the base of that machine's sole plate. Since the base of the sole plate is normally a soft rubber-like material (for example neoprene rubber) to cushion the abrasive sheet against the surface being sanded, it is not protected against the heat which may be generated if it were to be allowed to make direct contact with the worksurface.

Thus it is an object of the present invention to provide abrasive sheets which can be employed on a variety of different machines while allowing the dust extraction facility to be employed but without suffering from the aforementioned problem.

SUMMARY OF THE INVENTION

In accordance with the present invention there is provided a sheet of abrasive material, such as sandpaper, of standard dimensions for use on a variety of different machines, said sheet having a plurality of separable or frangible areas delineated by perforations enabling selected ones of said areas to be separated from the sheet to form holes in said sheet according to one desired pattern of an array of patterns of areas suitable for a particular abrading or sanding machine to which said sheet is to be fitted.

Of course, where the machine in question is not of the type incorporating dust extraction, or if for any reason the user does not wish to employ the vacuum dust extraction facility of his/her machine, then none of said areas is separated from the sheet. In that event the sheet performs as an ordinary sheet of abrasive.

On the other hand, the perforated areas are provided so that they may be pushed out by the user according to the pattern of holes formed on his/her particular machine.

Preferably the sheet is provided with instructions on one surface, for example, its front surface, indicating to the user which areas should be removed to suit particular machines.

The term "of standard dimensions" as used herein refers, for example, to the standard sheet sizes of sandpaper in the United Kingdom as set down in BS871. Several sanding machines are adapted, on the whole, to employ sheets of abrasive which conform to these standards. However, it should be appreciated that the scope of the present invention is not limited by particular standards as such, but rather by the sizes of sheets generally or widely adopted in a particular market at any given time. Also it is not intended to limit the application of the present invention geographically; it will have utility in any country in which abrading machines of the type discussed above are used.

Also in accordance with the present invention is a method for using the abrasive sheet including the steps of separating the appropriate frangible areas from the abrasive sheet and connecting the sheet to the sole plate so that the pattern of separated frangible areas matches the pattern of dust extraction holes in the sole plate of a particular abrasive machine, then using the machine to abrade a workpiece.

DETAILED DESCRIPTION OF THE PREFERRED EMBODIMENTS

Figure 1:
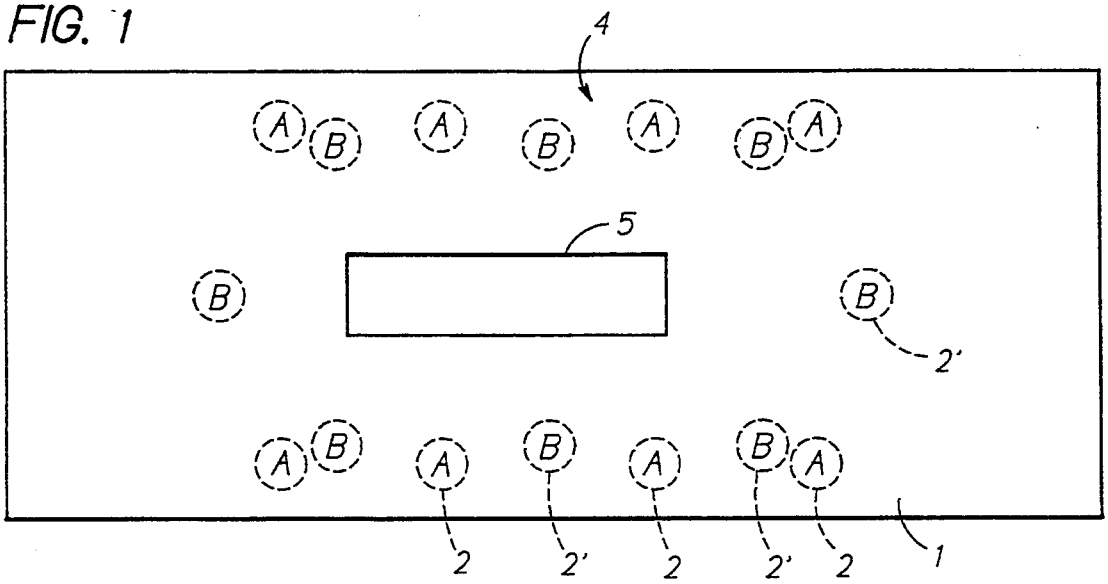
FIG. 1 is a back view of an abrasive sheet according to the present invention in which various patterns of punch-out frangible areas are indicated by phantom-line circles.

In FIG. 1, the back of a sheet 1 of sandpaper is shown. The sheet is provided with a plurality of perforated delineated or punch-out areas 2, 2' forming an array of patterns of areas such that any of such areas may be pushed or punched out to form said pattern of holes in the paper. The punch-out areas 2, 2' need not be circles. Depending upon the sanding machines, areas 2,2' may be oval, rectangular, or any geometry necessary to match the holes in the various sole plates contemplated to be in use in a given market.

In the first embodiment, Sheet 1 is sized to fit a particular range of orbital sanding machines, that is to say, those which employ ⅓-sheet sizes according to British Standard 871. ½-sheet or ¼-sheet sanding machines are also available. The array of patterns, and indeed sizes, of said punch-out areas 2, 2' are arranged to correspond with a plurality of different sanding machines within the size range for that sheet.

Thus the pattern of punch-out areas 2, for the ⅓-sheet machine, corresponds to the size and arrangement of holes in the sole plate of an orbital sander provided with dust extraction facilities marketed, for example, by the assignee of the present applicants, while the size and pattern of punch-out areas 2' correspond with a competitor's model. Additional patterns could be added as desired, even with such overlapping as may be necessary to accommodate further models as may be, or as may become, available. As a result, said array 4 of patterns of various configurations is generated.

The punch-out areas 2, 2' are separately identified on the back of the Sheet 1 by printed indicia such as "A" and "B" as shown, preferably together with instructions shown schematically, as 5 to the user to push out those areas marked A, B or C, etc., according to the model which the user is about to operate. Thus there may also be printed on the sheet 1 a list of models together with the respective letter or other suitable symbol or indicium identifying which holes are to be formed. In any event, it is evident that the user need not push out any holes if desired. Accordingly, the perforations are arranged so that the punch-out areas 2, 2' are not so easily separated from the sheet 1 as to be dislodged during a normal sanding operation. For the disclosed embodiment, a suitable perforation size is about one millimeter long; the perforations are also spaced apart about a millimeter.

Figure 2:
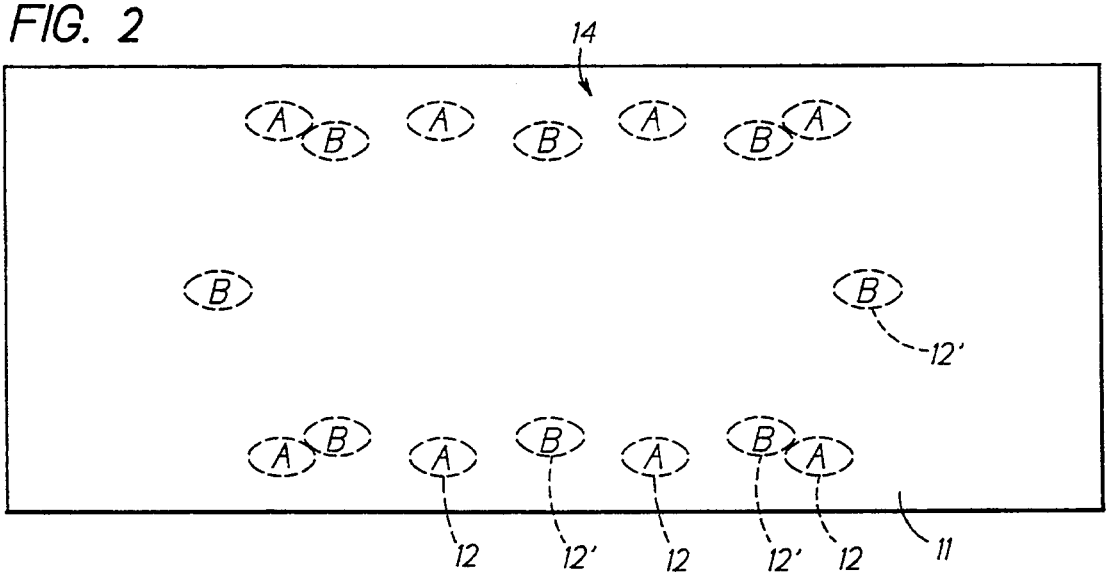
FIG. 2 is a back view of an abrasive sheet according to a second embodiment of the Present invention in which various patterns of punch-out frangible or separable areas are indicated by phantom-line ovals.
Figure 3:
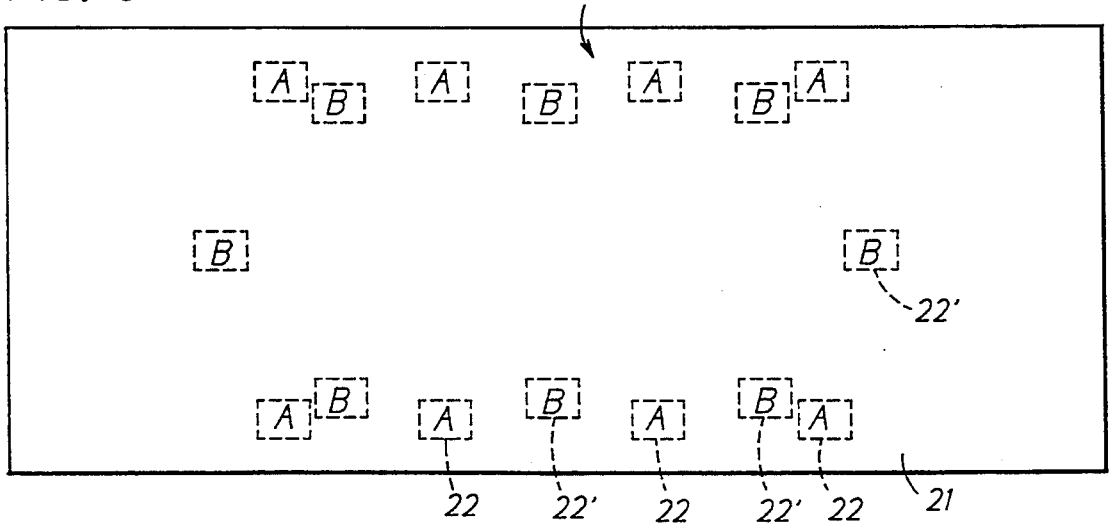
FIG. 3 is a back view of an abrasive sheet according to a third embodiment of the present invention in which various patterns of punch-out separable areas are indicated by phantom-line rectangles.

In a second embodiment, as shown in FIG. 2, sheet 11 is provided with a similar array 14 of oval-shaped areas 12, 12'. A third embodiment is shown in FIG. 3, in which another similar array 24 of rectangular areas 22, 22' is formed in sheet 21.

Figure 4:
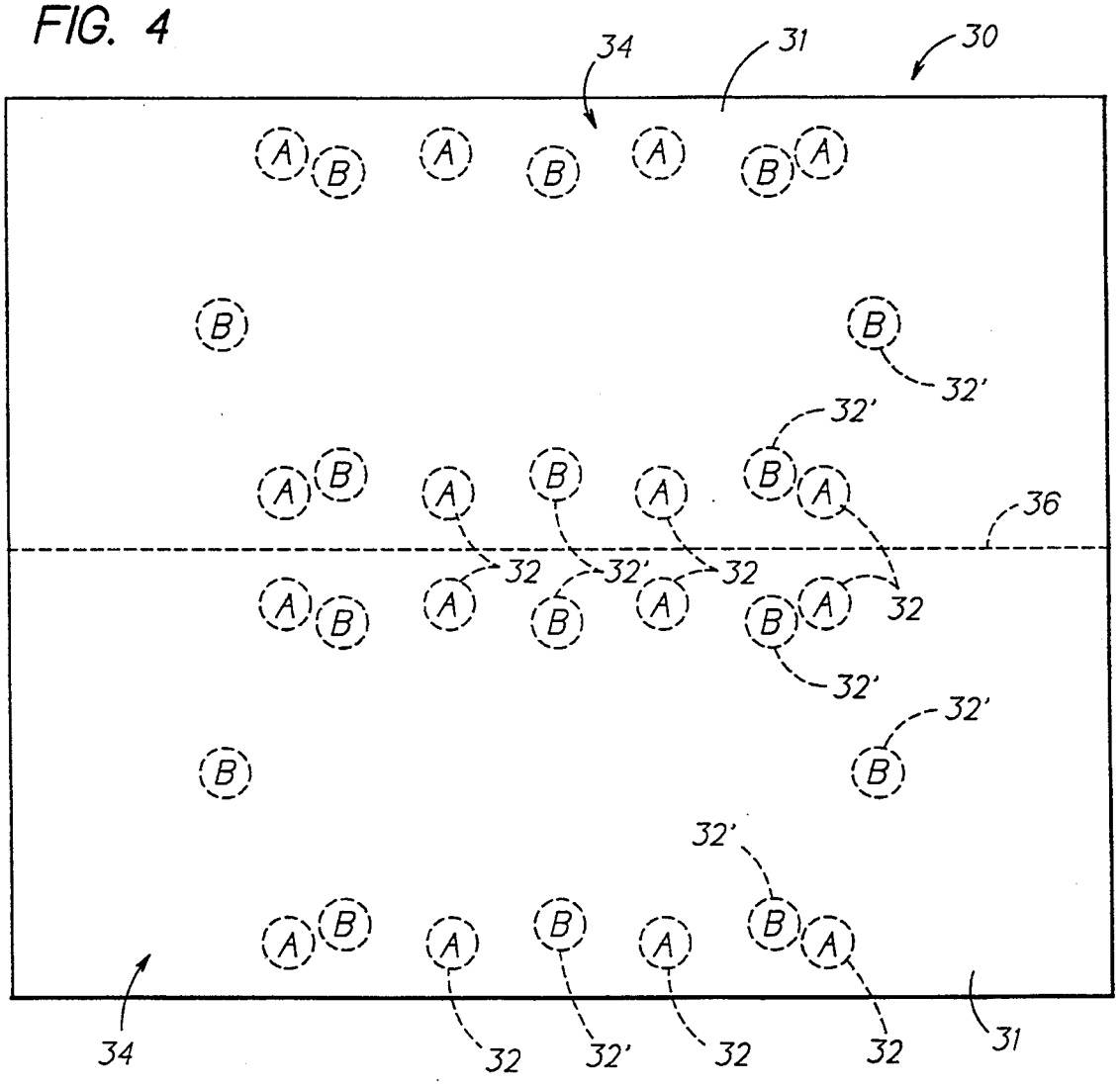
FIG. 4 is a back view of an abrasive sheet according to a fourth embodiment of the present invention in which various patterns of punch-out separable areas are indicated by phantom-line circles, and wherein the sheet itself is a frangible area of a larger sheet of abrasive material.

The front (not shown) of the sheet 1 appears as an ordinary sheet of sandpaper. Moreover, sheets may be provided ready-cut into $\frac{1}{3}$ or $\frac{1}{2}$ or $\frac{1}{4}$ sizes, as desired, or in full-size sheets, preferably with separable or frangible perforated delineations dividing the sheet into the $\frac{1}{3}$-, $\frac{1}{2}$- or $\frac{1}{4}$-sheet sizes. An example is shown schematically in FIG. 4, in which a whole sheet 30 is formed of two half-sheets 31 separated by perforation line 36. Arrays 34 of separable areas 32, 32' are also shown schematically.

The above-described embodiments, of course, are not to be construed as limiting the breadth and scope of the present invention. Modifications, and other alternative constructions, will be apparent which are within the spirit and scope of the invention as defined in the appended claims.

What is claimed is:

1. A sheet of abrasive material for use on a variety of different abrading machines comprising:

a plurality of separable areas formed in said sheet delineated by perforations enabling selected ones of said areas to be separated from said sheet to form holes in said sheet according to one pattern of an array of desired patterns suitable for a particular sanding machine to which said sheet is to be fittted wherein each said area is bounded by the remainder of the sheet.

2. A sheet as claimed in claim 1 in which information is provided on said sheet's back surface indicating to the user which of said areas should be removed to suit a particular machine.

3. A sheet of abrasive material for use with any one abrading machine selected from a group of at least two abrading machines, each of said machines having a different pattern of dust extraction holes formed in a respective sole plate thereof, comprising:

(a) an array of patterns of separable areas formed in said sheet of abrasive material;

(b) each said pattern matching one of said different patterns of dust extraction holes formed in said respective sole plates;

(c) said separable areas in said sheet of abrasive material including means for separating said areas from said sheet such that separable areas not separated from said sheet prior to connection to said sole plate are not easily dislodged during normal abrading operation; and wherein (d) each said area is bounded by the remainder of the sheet.

4. The sheet of abrasive material claimed in claim 3, wherein said means for separating said areas includes perforations formed in said sheet of abrasive material.

5. The sheet of abrasive material claimed in claim 4, wherein said perforations are arranged in circular configurations.

6. The sheet of abrasive material claimed in claim 5, wherein said perforations in said circular configurations are about one millimeter long and are spaced apart also about one millimeter.

7. The sheet of abrasive material claimed in claim 4, wherein said perforations are arranged in oval configurations.

8. The sheet of abrasive material claimed in claim 4, wherein said perforations are arranged in rectangular configurations.

9. The sheet of abrasive material claimed in claim 4, wherein said perforations are arranged in configurations matching the configurations of said dust extraction holes in said respective sole plate.

10. The sheet of abrasive material claimed in claim 3, wherein said sheet is itself a separable area of a larger sheet of abrasive material.

11. The sheet of abrasive material claimed in claim 10, wherein said larger sheet includes separable perforated delineations defining the outer perimeter of said sheet of abrasive material.

12. The sheet of abrasive material claimed in claim 11, wherein said abrasive material is sandpaper.

13. A method for using the same sheet of abrasive material with any one abrading machine selected from a group of at least two abrading machines, each having a different pattern of dust extraction holes formed in a respective sole plate thereof, comprising the steps of:

(a) providing a sheet of abrasive material having an array of patterns of separable areas formed therein, each said pattern matching one of said different patterns of dust extraction holes formed in said different sole plates;

(b) separating respective separable areas formed in said sheet of abrasive material in a pattern corresponding to the pattern of dust extraction holes formed in said sole plate of said selected abrading machine;

(c) connecting said sheet of abrasive material to said sole plate so that said pattern of separated areas matches said pattern of dust extraction holes in said sole plate; and (d) operating said abrading machine to abrade a workpiece.

14. The method claimed in claim 13 wherein:

(a) said sheet of abrasive material further includes indicia operatively associated with separable areas corresponding to information formed on a surface of said sheet of abrasive material for matching a particular pattern of separable areas to said pattern of dust extraction holes formed in said sole plate of said selected abrading machine; and further comprising the step of (b) prior to separating said areas from said sheet of abrasive material, using said information and said indicia to match said pattern of separable areas to said pattern of dust extraction holes formed in said sole plate of said selected abrading machine.

15. A sheet of abrasive material for use with any one abrading machine selected from a group of at least two abrading machines, each of said machines having a different pattern of dust extraction holes formed in a respective sole plate thereof, comprising:

(a) an array of patterns of separable areas formed in said sheet of abrasive material;

(b) each said pattern matching one of said different patterns of dust extraction holes formed in said respective sole plates;

(c) said separable areas in said sheet of abrasive material including means for separating said areas from said sheet such that separable areas not separated from said sheet prior to connection to said sole plate are not easily dislodged during normal abrading operation; and (d) said means for separating said areas including perforations formed in said sheet of abrasive material, said perforations being arranged in circular configurations.

16. The sheet of abrasive claimed in claim 15, wherein said perforations in said circular configurations are about one millimeter long and are spaced apart also about one millimeter.

17. A sheet of abrasive material for use with any one abrading machine selected from a group of at least two abrading machines, each of said machines having a different pattern of dust extraction holes formed in a respective sole plate thereof, comprising:

(a) an array of patterns of separable areas formed in said sheet of abrasive material;

(b) each said pattern matching one of said different patterns of dust extraction holes formed in said respective sole plates;

(c) said separable areas in said sheet of abrasive material including means for separating said areas from said sheet such that separable areas not separated from said sheet prior to connection to said sole plate are not easily dislodged during normal abrading operation; and (d) said means for separating said areas including perforations formed in said sheet of abrasive material, said perforations being arranged in oval configurations.

18. A method for using the same sheet of abrasive material with any one abrading machine selected from a group of at least three abrading machines, each having either a different pattern or no pattern of dust extraction holes formed in a respective sole plate thereof, comprising the steps of:

(a) providing a sheet of abrasive material having an array of patterns of separable areas formed therein, each said pattern matching one of said different patterns of dust extraction holes formed in said different sole plates, said separable areas in said sheet of abrasive material including means for separating said areas from said sheet such that separable areas not separated from said sheet prior to connection to said sole plate are not easily dislodged during normal abrading operation, and further wherein each of said areas in bounded by the remainder of the sheet;

(b) connecting said sheet of abrasive material to said sole plate without first having separated any of said areas from said sheet; and (c) operating said abrading machine to abrade a workpiece.

19. The method claimed in claim 18 wherein said sheet of abrasive material further includes indicia operatively associated with separable areas corresponding to information formed on a surface of said sheet of abrasive material for matching a particular pattern of separable areas to said pattern of dust extraction holes formed in said sole plate of said selected abrading machine.

* * * * *

UNITED STATES PATENT AND TRADEMARK OFFICE

CERTIFICATE OF CORRECTION

PATENT NO. : 5,367,839
DATED : November 29, 1994
INVENTOR(S) : Phillip W. Pearce It is certified that error appears in the above-indentified patent and that said Letters Patent is hereby corrected as shown below:

On the title page

Item 73 Assignee: Black & Decker Inc., Newark, Del.

Attorney, Agent, or Firm---Dennis A. Dearing; John D. Del Ponti; Charles E. Yocum Signed and Sealed this Twenty-ninth Day of August, 1995

*Attest:*

Bruce Lehman

BRUCE LEHMAN

*Attesting Officer*

*Commissioner of Patents and Trademarks*